US011333122B2

(12) United States Patent
Funato

(10) Patent No.: US 11,333,122 B2
(45) **Date of Patent: *May 17, 2022**

(54) IGNITION CONTROL SYSTEM

(71) Applicant: DENSO CORPORATION, Kariya (JP)

(72) Inventor: Ippei Funato, Kariya (JP)

(73) Assignee: DENSO CORPORATION, Kariya (JP)

( * ) Notice: Subject to any disclaimer, the term of this patent is extended or adjusted under 35 U.S.C. 154(b) by 317 days.

This patent is subject to a terminal disclaimer.

(21) Appl. No.: 16/531,195

(22) Filed: Aug. 5, 2019

(65) Prior Publication Data

US 2019/0353134 A1 Nov. 21, 2019

Related U.S. Application Data

(63) Continuation of application No. PCT/JP2018/002806, filed on Jan. 29, 2018.

(30) Foreign Application Priority Data

Feb. 6, 2017 (JP) ..... JP2017-019843

(51) Int. Cl.

| | |
|---|---|
| ***F02P 9/00*** | (2006.01) |
| ***F02P 1/08*** | (2006.01) |
| ***F02P 3/045*** | (2006.01) |
| ***F02P 5/15*** | (2006.01) |

(52) U.S. Cl.

CPC ..... *F02P 9/007* (2013.01); *F02P 1/086* (2013.01); *F02P 3/0453* (2013.01); *F02P 5/1502* (2013.01)

(58) Field of Classification Search

CPC . F02D 9/007; F02D 9/002; F02P 1/086; F02P 3/0453

USPC ..... 123/596, 605, 445, 406.14, 618, 620, 123/621, 622, 623, 636, 637; 361/263

See application file for complete search history.

(56) References Cited

U.S. PATENT DOCUMENTS

| | | | | |
|---|---|---|---|---|
| 6,397,827 | B1 * | 6/2002 | Kato | F02P 9/007 123/620 |
| 6,513,320 | B1 * | 2/2003 | Nishimura | F01N 3/0842 60/285 |
| 6,694,959 | B1 * | 2/2004 | Miwa | F02P 3/053 123/406.53 |
| 8,036,808 | B2 * | 10/2011 | Mori | F02P 9/00 701/102 |

(Continued)

FOREIGN PATENT DOCUMENTS

| | | |
|---|---|---|
| JP | 2010-138880 | 6/2010 |

*Primary Examiner* — Logan M Kraft
*Assistant Examiner* — Joshua Campbell
(74) *Attorney, Agent, or Firm* — Nixon & Vanderhye P.C.

(57) ABSTRACT

An ignition control system performs discharge generation control, in which a discharge spark is generated, once or a plurality of times during a single combustion cycle. The ignition control system successively calculates an approximate energy density based on a secondary current and a discharge path length. During a predetermined period after blocking of a primary current is performed during a single combustion cycle, the ignition control system calculates an integrated value by integrating the discharge path length at this time, based on the approximate energy density being greater than a predetermined value. The ignition control system performs the discharge generation control again based on the calculated integrated value being less than a first threshold.

17 Claims, 11 Drawing Sheets

(56) References Cited

U.S. PATENT DOCUMENTS

| | | | | |
|---|---|---|---|---|
| 2003/0209223 | A1* | 11/2003 | Armstrong | F02D 37/02 123/305 |
| 2005/0028799 | A1* | 2/2005 | Montgomery | F02B 23/101 123/596 |
| 2007/0175461 | A1 | 8/2007 | Wada et al. | |
| 2015/0167623 | A1* | 6/2015 | Sanders | F02P 3/08 123/605 |
| 2017/0117078 | A1* | 4/2017 | Kyouda | F02P 3/0846 |

* cited by examiner

IGNITION CONTROL SYSTEM

CROSS-REFERENCE TO RELATED APPLICATIONS

The present application is a continuation application of International Application No. PCT/JP2018/002806, filed Jan. 29, 2018, which claims priority to Japanese Patent Application No. 2017-019843, filed on Feb. 6, 2017. The entire contents of each of which are hereby incorporated by reference.

BACKGROUND

Technical Field

The present disclosure relates to an ignition control system that is used in an internal combustion engine.

Background Art

In recent years, to improve fuel efficiency of internal combustion engines for automobiles, technologies related to combustion control (lean burn engines) of lean fuel and exhaust gas recirculation (EGR) in which a combustible air-fuel mixture is circulated to a cylinder of the internal combustion engine are being studied. In these technologies, as an ignition system for effectively burning fossil fuel that is contained in the air-fuel mixture, a multiple ignition system in which a spark plug continuously performs discharge a plurality of times at an ignition timing of the internal combustion engine is sometimes used.

SUMMARY

The present disclosure is an ignition control system that is applied to an internal combustion engine that includes a spark plug, an ignition coil including a primary coil and a secondary coil, a voltage value detecting unit, and a secondary current detecting unit. The ignition control system performs discharge generation control, in which a discharge spark is generated, once or a plurality of times during a single combustion cycle. The ignition control system successively calculates an approximate energy density based on a secondary current and a discharge path length. During a predetermined period after blocking of a primary current is performed during a single combustion cycle, the ignition control system calculates an integrated value by integrating the discharge path length at this time, based on the approximate energy density being greater than a predetermined value. The ignition control system performs the discharge generation control again based on the calculated integrated value being less than a first threshold.

BRIEF DESCRIPTION OF THE DRAWINGS

The above-described object, other objects, characteristics, and advantages of the present disclosure will be further clarified through the detailed description below, with reference to the accompanying drawings. The drawings are as follows.

DESCRIPTION OF THE EMBODIMENTS

Figure 1:
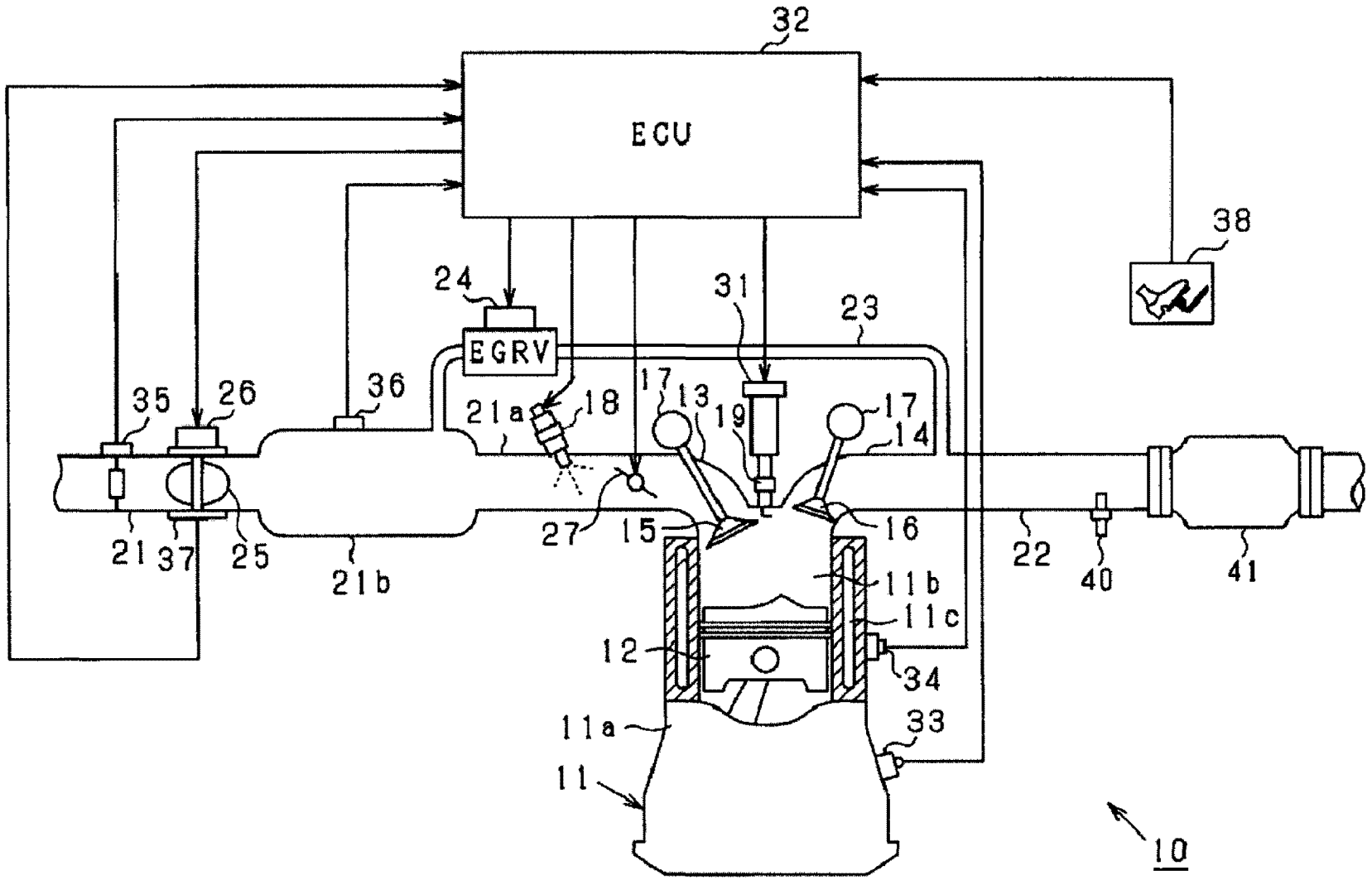
FIG. 1 is an overall configuration diagram of an engine system according to a present embodiment.

In this multiple ignition system, a problem arises in that electrode wear in the spark plug and power consumption in an ignition coil that supplies a high voltage to the spark plug increase by an extent amounting to the execution of a plurality of discharge operations during a single ignition cycle. In addition, wastefulness in terms of energy, that is, discharge operations being unnecessarily repeated even in cases in which the air-fuel mixture can be favorably ignited by an initial discharge also occurs.

As a countermeasure against the foregoing issues, the following related technology is known. That is, when a voltage peak of a secondary voltage that is applied to an ignition coil exceeds a determination threshold during a capacitive discharge period, an accumulated time of an exceedance interval during which the voltage peak exceeds the determination threshold or an accumulated value of the secondary voltage during the exceedance intervals is measured. Then, based on the measured accumulated time of the exceedance interval or the accumulated value of the secondary voltage during the exceedance intervals, whether an air-fuel mixture is in a combustion state or a misfire state is determined.

The related technology describes that, during execution of capacitive discharge, between cases in which the air-fuel mixture is burned and cases in which misfire occurs, the secondary voltage that is detected when the air-fuel mixture is burned is lower. A reason for this is thought to be that combustion ions are produced as a result of the air-fuel mixture being ignited by the discharge that is generated in the spark plug. As a result of the combustion ions being present between the electrodes in the spark plug, a secondary current easily flows between the electrodes of the spark plug.

Consequently, discharge resistance decreases. In accompaniment, the secondary voltage that is applied to the spark plug decreases.

Here, in a high flow field in which a flow rate of airflow inside a combustion chamber is high, an assumption can be made that the combustion ions that are produced by the air-fuel mixture being ignited are carried away by the airflow and the combustion ions that are present between the electrodes of the spark plug decrease. In this state, the discharge resistance hardly decreases. In accompaniment, the secondary voltage that is applied to the spark plug hardly decreases. In this case, in the related technology, even when the air-fuel mixture is in the combustion state, because the secondary voltage applied to the spark plug is in a high state, an erroneous determination that the air-fuel mixture is in a misfire state may be made. In this regard, there is room for improvement in determination control for determining a combustion state of an air-fuel mixture.

It is thus desired to provide an ignition control system that is capable of more accurately estimating a combustion state of a combustible air-fuel mixture, and improving the combustion state of the combustible air-fuel mixture by causing a spark plug to perform re-discharge, as required.

An exemplary embodiment of the present disclosure provides an ignition control system that is applied to an internal combustion engine that includes: a spark plug that generates, between a pair of discharge electrode, a discharge spark for igniting a combustible air-fuel mixture inside a cylinder of the internal combustion engine; an ignition coil that includes a primary coil and a secondary coil, and applies a secondary voltage to the spark plug through the secondary coil; a voltage value detecting unit that detects a voltage value of at least either of a primary voltage that is applied to the primary coil and the secondary voltage that is applied to the spark plug; and a secondary current detecting unit that detects a secondary current that flows to the spark plug.

The ignition control system includes a primary current control unit, a discharge path length calculating unit, an approximate energy density calculating unit, and an integrated value calculating unit.

The primary current control unit performs discharge generation control, in which the discharge spark is generated in the spark plug, once or a plurality of times during a single combustion cycle by causing blocking of a primary current to the primary coil to be performed after conduction of the primary current is performed.

The discharge path length calculating unit successively calculates a discharge path length as a length of the discharge spark that is formed between the discharge electrodes based on the voltage value detected by the voltage value detecting unit.

The approximate energy density calculating unit that successively calculates an approximate energy density that serves as an approximate value of energy density that is energy per unit length of the discharge spark by dividing the secondary current detected by the secondary current detecting unit by the discharge path length calculated by the discharge path length calculating unit.

During a predetermined period after blocking of the primary current is performed during the single combustion cycle, the integrated value calculating unit calculates an integrated value by integrating the discharge path length calculated at this time by the discharge path length calculating unit, based on the approximate energy density calculated by the approximate energy density calculating unit being greater than a predetermined value.

The primary current control unit performs the discharge generation control again based on the integrated value calculated by the integrated value calculating unit being less than a first threshold.

In the present disclosure, it has been found that a discharge spark of which the energy density of the discharge spark that is calculated by discharge energy determined by a product of the secondary current and the secondary voltage being divided by the discharge path length is greater than a predetermined value contributes to the combustion of the combustible air-fuel mixture, whereas a discharge spark of which the energy density is less than the predetermined value hardly contributes to the combustion of the combustible air-fuel mixture. In addition, a variation width of the secondary current during a discharge period in which discharge is generated in the spark plug is large at about 200 to 0 [mA].

Meanwhile, a variation width of a secondary induction discharge voltage (maintained voltage) is small at about 0.5 to 10 [kV]. From the foregoing, it has been found that variations in the secondary voltage in a tip portion of a spark of which the current is large is moderate (in other words, the variation width of the second voltage is small), and the secondary current is a more dominant parameter in terms of determining the magnitude of the value of discharge energy.

In addition, in accompaniment with the findings, it has been found that the energy density of the discharge spark can be approximated by dividing the secondary current by the discharge path length. In addition, when the energy density of the discharge spark is the same, a relationship is such that the discharge energy of the discharge spark increases and a surface area of the discharge spark increases as the discharge path length increases. From this relationship, it is clear that the discharge path length is a parameter that accurately reflects the magnitude of the discharge energy of the discharge spark.

Based on the foregoing, it has been found that whether the discharge spark that is generated in the spark plug contributes to the combustion of the combustible air-fuel mixture can be estimated from the approximate energy density. Furthermore, whether the combustion state of the combustible air-fuel mixture is favorable can be more accurately estimated based on the integrated value of the discharge path length of the discharge spark of which the approximate energy density is greater than the predetermined value.

Therefore, in the present ignition control system, the approximate energy density calculating unit is provided. The approximate energy density calculating unit successively calculates the approximate energy density that is an approximate value of the energy density of the discharge spark by dividing the secondary current detected by the secondary current detecting unit by the discharge path length calculated by the discharge path length calculating unit.

In addition, under a condition that the approximate energy density calculated by the approximate energy density calculating unit is greater than the predetermined value during the predetermined period after blocking of the primary current is performed during a single combustion cycle, the integrated value calculating unit calculates the integrated value by integrating the discharge path length that is calculated by the discharge path length calculating unit. That is, the calculated integrated value is an integrated value of the discharge path length of the discharge spark that contributes to the combustion of the combustible air-fuel mixture during the predetermined period.

Therefore, when the integrated value that is integrated during the predetermined period is less than the first threshold, the combustion state of the combustible air-fuel mixture can be estimated as not being favorable. Therefore, under a condition that the integrated value calculated by the integrated value calculating unit is less than the first threshold, the discharge generation control is performed again by the primary current control unit. As a result, the combustion state of the combustible air-fuel mixture can be made favorable. Meanwhile, when the integrated value calculated by the integration value calculating unit is greater than the first threshold, the combustion state of the combustible air-fuel mixture can be estimated as being favorable.

Therefore, as a result of the discharge generation control not being performed by the primary current control unit again, energy being unnecessarily consumed in the spark plug can be suppressed. In addition, as a result of the present control being performed through use of the approximate energy density instead of the energy density, a calculation step for discharge energy can be omitted (in other words, a calculation step for calculating a product of the secondary current and the secondary voltage can be omitted). Furthermore, a calculation circuit that is required to perform the present control can be simplified.

With reference to FIG. 1, an engine system 10 includes an engine 11 that is a spark-ignition-type multiple-cylinder internal combustion engine. Here, FIG. 1 shows an example of only a single cylinder among the plurality of cylinders provided in the engine 11.

The engine system 10 performs control to change an air-fuel ratio of an air-fuel mixture to a rich side or a lean side in relation to a theoretical air-fuel ratio, based on an operation state of the engine 11. For example, the engine system 10 performs control to change the air-fuel ratio of the air-fuel mixture to the lean side when the operation state of the engine 11 is within an operation range of low rotation and low load.

A combustion chamber 11*b* and a water jacket 11*c* are formed inside an engine block 11*a* that configures a main body portion of the engine 11. The engine block 11*a* is provided so as to house a piston 12 capable of back-and-forth motion. The water jacket 11*c* is a space through which a cooling liquid (also referred to as cooling water) can flow. The water jacket 11*c* is provided so as to surround the periphery of the combustion chamber 11*b*.

An intake port 13 and an exhaust port 14 are formed so as to be communicable with the combustion chamber 11*b*, in a cylinder head that is an upper portion of the engine block 11*a*. In addition, an intake valve 15, a discharge valve 16, and a valve driving mechanism 17 are provided in the cylinder head. The intake valve 15 is provided to control a communication state between the intake port 13 and the combustion chamber 11*b*. The exhaust valve 15 is provided to control a communication state between the exhaust port 14 and the combustion chamber 11*b*. The valve driving mechanism 17 is provided to enable the intake valve 15 and the exhaust valve 16 to perform opening/closing operations at predetermined timings.

An intake manifold 21*a* is connected to the intake port 13. The intake manifold 21*a* includes an electromagnetic-drive-type injector 18 to which high-pressure fuel is supplied from a fuel supply system. The injector 18 is a port-injection-type fuel injection valve that sprays fuel towards the intake port 13 in accompaniment with energization.

A surge tank 21*b* is arranged on an upstream side of the intake manifold 21*a* in an intake flow direction. An exhaust pipe 22 is connected to the exhaust port 14.

An EGR passage 23 is provided so as to be capable of introducing a portion of exhaust gas that is discharged from the exhaust pipe 22 into intake air (hereafter, the exhaust gas that is introduced into the intake air is referred to as EGR gas) by connecting the exhaust pipe 22 and the surge tank 21*b*. An EGR control valve 24 is disposed on the EGR passage 23. The EGR control valve 24 is provided so as to be capable of controlling an EGR rate (a mixing ratio of the EGR gas in gas before combustion that is drawn into the combustion chamber 11*b*) based on a degree of opening thereof. Therefore, the EGR passage 23 and the EGR control valve 24 correspond to an exhaust recirculation mechanism.

A throttle valve 25 is disposed in an intake pipe 21 on an upstream side of the surge tank 21*b* in the intake flow direction. A degree of opening of the throttle valve 25 is controlled by an operation of a throttle actuator 26, such as a direct-current (DC) motor. In addition, an airflow control valve (corresponding to an airflow generating portion) 27 for generating a swirl flow and a tumble flow is provided near the intake port 13.

A catalyst 41, such as a three-way catalyst, for purifying CO, HC, NOx, and the like in the exhaust gas is provided in the exhaust pipe 22. An air-fuel ratio sensor 40 (such as a linear air-fuel [A/F] sensor) for detecting the air-fuel ratio of the air-fuel mixture, with the exhaust gas as a detection target, is provided on an upstream side of the catalyst 41.

The engine system 10 includes an ignition circuit unit 31, an electronic control unit 32, and the like.

The ignition circuit unit 31 is configured to generate a discharge spark in a spark plug 19. The discharge spark is generated to ignite fuel air-fuel mixture inside the combustion chamber 11*b*. The electronic control unit 32 is a so-called engine electronic control unit (ECU). The electronic control unit 32 is configured to control operations of each unit including the injector 18 and the ignition circuit unit 31, based on the operation state of the engine 11 that is acquired based on output from various sensors such as a crank angle sensor 33 (referred to, hereafter, in an abbreviated manner as "engine parameters").

Regarding ignition control, the electronic control unit 32 is configured to generate an ignition signal IGt based on the acquired engine parameters and output the ignition signal IGt. The ignition signal IGt prescribes an optimal ignition timing and a discharge current (spark discharge current) based on a state of the gas inside the combustion chamber 11*b* and the output of the engine 11 that is required (that change based on the engine parameters).

The crank angle sensor 33 is a sensor for outputting a rectangular crank angle signal at every predetermined crank angle (such as at a 30° CA cycle) of the engine 11. The crank angle sensor 33 is mounted in the engine block 11*a*. A cooling water temperature sensor 34 is a sensor for detecting (acquiring) a cooling water temperature that is a temperature of the cooling liquid that flows inside the water jacket 11. The cooling water temperature sensor 34 is mounted in the engine block 11*a*.

An airflow meter 35 is a sensor for detecting (acquiring) an intake air amount (a mass flow rate of intake air that flows through the intake pipe 21 and is introduced into the combustion chamber 11*b*). This airflow meter 35 is mounted in the intake pipe 21 on the upstream side of the throttle valve 25 in the intake flow direction. An intake pressure sensor 36 is a sensor for detecting (acquiring) intake pressure that is pressure inside the intake pipe 21. The intake pressure sensor 36 is mounted in the surge tank 21*b*.

A throttle opening sensor 37 is a sensor that generates output that corresponds to the degree of opening of the throttle valve 25 (throttle opening). The throttle opening sensor 37 is provided within the throttle actuator 26. An accelerator position sensor 38 is provided so as to generate output that corresponds to an accelerator operation amount.

<Configuration of the Periphery of the Ignition Circuit Unit>

Figure 2:
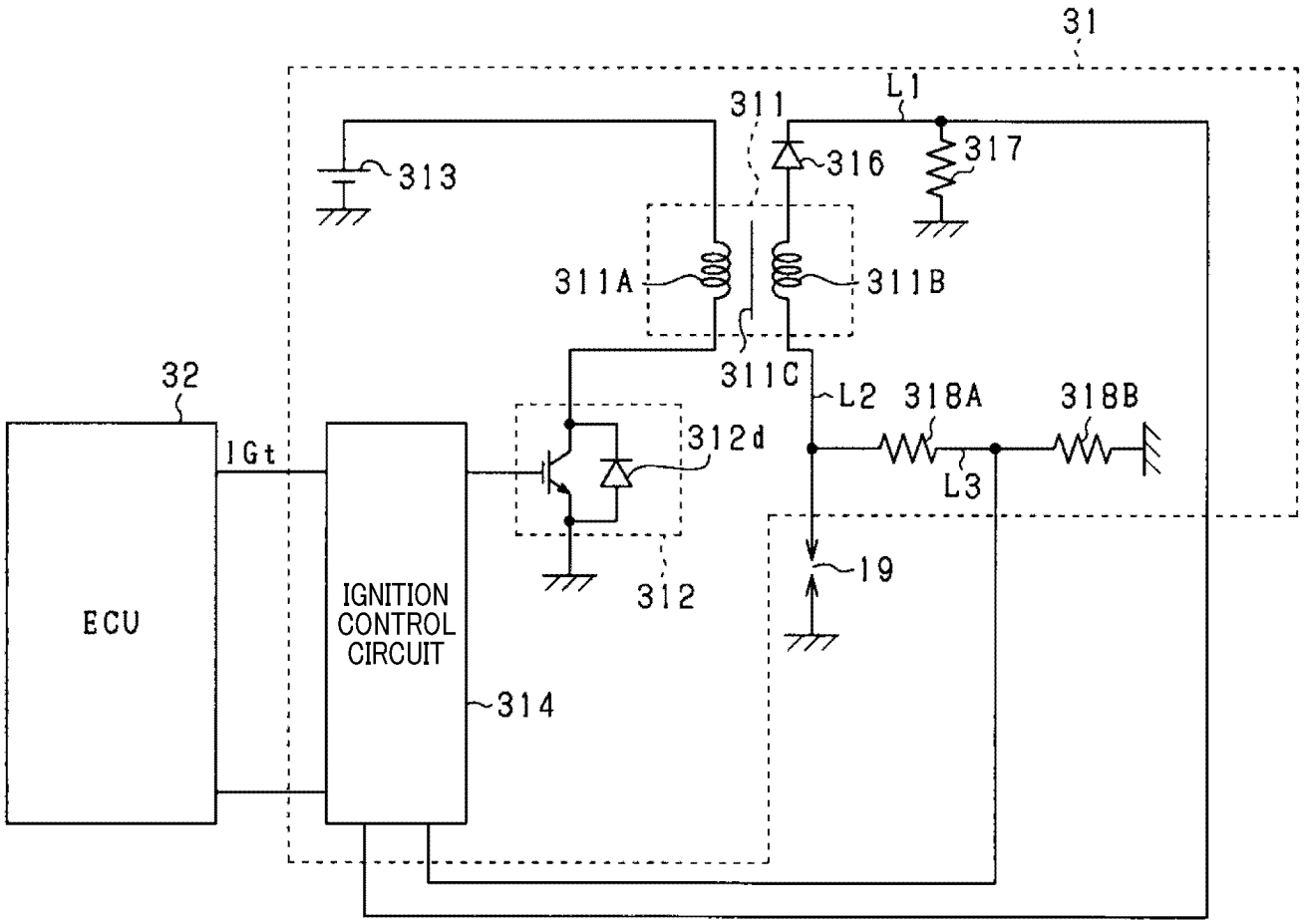
FIG. 2 is an overall configuration diagram of an ignition circuit unit shown in FIG. 1.

With reference to FIG. 2, the ignition circuit unit 31 includes an ignition coil 311, an insulated-gate bipolar transistor (IGBT) 312 (corresponding to a switching element), a power supply unit 313, and an ignition control circuit 314.

The ignition coil 311 includes a primary coil 311A, a secondary coil 311B, and a core 311C. A first end of the primary coil 311A is connected to the power supply unit 313. A second end of the primary coil 311A is connected to a collector terminal of the IGBT 312. In addition, an emitter terminal of the IGBT 312 is connected to a grounding side. A diode 312*d* is connected in parallel to both ends (the collector terminal and the emitter terminal) of the IGBT 312.

A first end of the secondary coil 311B is connected to a current detection path L1 with a diode 316 therebetween. A resistor 317 for secondary current detection is provided on the current detection path L1. A first end of the resistor 317 is connected to the first end of the secondary coil 311B with the diode 316 therebetween. A second end of the resistor 317 is connected to the grounding side.

The ignition control circuit 314, described hereafter, is connected to the resistor 317. An anode of the diode 316 is connected to the first end side of the secondary coil 311*b* so as to prohibit a flow of current in a direction towards a second end side of the secondary coil 311B via the resistor 317B from the grounding side and control a secondary current (discharge current) I2 to a direction towards the secondary coil 311B from the spark plug 19.

The second end of the secondary coil 311B is connected to the spark plug 19. A voltage detection path (corresponding to a voltage value detecting unit) L3 is connected to a path L2 that connects the second of the secondary coil 311B and the spark plug 19. Resistors 318A and 318B for voltage detection are provided on the voltage detection path L3. One end of the resistor 318A is connected to the path L2, and the other end is connected to the resistor 318B. One end of the resistor 318B is connected to the resistor 318A and the other end is connected to the grounding side. In addition, a node (reference number omitted) between the resistor 318A and the resistor 318B is connected to the ignition control circuit 314, described hereafter. A secondary voltage V2 that is applied to the spark plug 19 is detected by the voltage detection path L3 such as this.

The electronic control unit 32 generates the ignition signal IGt based on the acquired engine parameters, as described above. The electronic control unit 32 then transmits the generated ignition signal IGt to the ignition control circuit 314. The ignition control circuit 314 performs ignition control based on the ignition signal IGt received from the electronic control unit 32.

In the ignition control, the ignition control circuit 314 outputs a drive signal IG for performing opening/closing control of the IGBT 312 to a gate terminal of the IGBT 312, and controls the IGBT 312 to perform conduction of a primary current I1 that flows to the primary coil 311A. The ignition control is control performed for the spark plug 19 that is provided inside the cylinder that includes the ignition control circuit 314. In other words, ignition control of the spark plug 19 that is provided in each cylinder is performed by the ignition control circuit 314 that is provided in the same cylinder.

The ignition control circuit 314 stops output of the drive signal IG to the gate terminal of the IGBT 312 by the electronic control unit 32 stopping the output of the ignition signal IGt after the elapse of a first predetermined amount of time. As a result, conduction of the primary current I1 that flows to the primary coil 311A is blocked in the IGBT 312 and a high voltage is induced in the secondary coil 311B. Dielectric breakdown occurs in the gas in a spark gap portion of the spark plug 19, and a discharge spark is thereby generated in the spark plug 19.

The ignition control circuit 314 successively detects the secondary voltage V2 that is applied to the voltage detection path L3 and calculates a discharge path length L of the discharge spark that is generated in the spark plug 19 based on the detected secondary voltage V2. In addition, the ignition control circuit 314 successively detects a secondary current I2 that flows to the current detection path L1 and calculates an approximate energy density D based on the detected secondary current I2 and the calculated discharge path length L of the discharge spark.

Therefore, the current detection path L1 and the ignition control circuit 314 correspond to a secondary current detecting unit. The voltage detection path L3 and the ignition control circuit 314 correspond to the voltage value detecting unit. In addition, the ignition control circuit 314 corresponds to a primary current control unit, a discharge path length calculating unit, an approximate energy density calculating unit, and an integrated value calculating unit.

Conventionally, when a combustible air-fuel mixture that is present inside the combustion chamber 11*b* is burned by a discharge spark being generated in the spark plug 19, a combustion state of the combustible air-fuel mixture is estimated based on changes in the secondary voltage V2 that is applied to the spark plug 19.

Specifically, when a voltage peak of the secondary voltage V2 of the discharge spark generated in the spark plug 19 exceeds a determination threshold and falls below the determination threshold, an accumulated time of an exceedance interval during which the voltage peak exceeds the determination threshold or an accumulated value of the secondary voltage V2 during the exceedance intervals is measured. Then, whether the combustible air-fuel mixture is in a combustion state or a misfire state is determined based on the measured accumulated time of the exceedance interval or accumulated value of the secondary voltage V2 during the exceedance intervals.

Here, in the engine system 10 according to the present embodiment, the airflow control valve 27 is provided near the intake port 13. When homogeneous lean burn is performed, airflow, such as a swirl flow or a tumble flow, is generated inside the combustion chamber 11*b* by the airflow control valve 27. Turbulence (disturbance) is induced and a combustion rate is improved.

At this time, because a speed of the airflow inside the combustion chamber 11*b* increases, it is assumed that combustion ions that are generated as a result of the combustible air-fuel mixture being ignited are swept away by the airflow, and the combustion ions present between the electrodes of the spark plug 19 decrease. In this state, discharge resistance hardly decreases. In accompaniment, the secondary voltage V2 applied to the spark plug 19 hardly decreases.

Therefore, should the combustion state of the combustible air-fuel mixture be estimated based on the secondary voltage V2, even when the combustible air-fuel mixture is in the combustion state, because the secondary voltage V2 that is applied to the spark plug 19 is in a high state, an erroneous estimation that the combustible air-fuel mixture is in a misfire state may be made.

As a countermeasure against the foregoing, according to the present embodiment, the combustion state of the combustible air-fuel mixture is estimated based on the approximate energy density D of the discharge spark and the discharge path length L of the discharge spark.

In the present disclosure, it has been found that a discharge spark of which the energy density of the discharge spark is greater than a predetermined value Th contributes to the combustion of the combustible air-fuel mixture, and a discharge spark of which the energy density of the discharge spark is less than the predetermined value Th hardly contributes to the combustion of the combustible air-fuel mixture. The energy density of the discharge spark is calculated by discharge energy that is determined by a product of the secondary current I2 and the secondary voltage V2 being divided by the discharge path length L.

Figure 3:
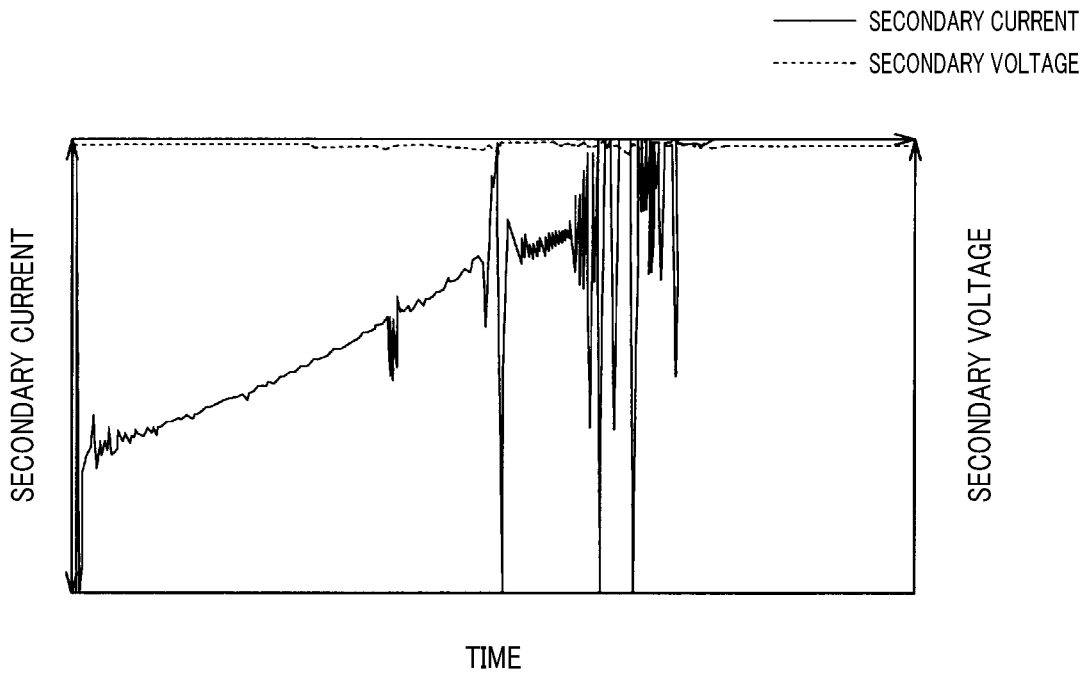
FIG. 3 is a graph of changes over time in a secondary current and a secondary voltage during a discharge period.

In addition, as shown in FIG. 3, in comparison to a variation width of the secondary current I2 being large (about 200 to 0 [mA]) during a discharge period in which the spark plug 19 is generating discharge, a variation width of the secondary voltage V2 is small (about 0.5 to 10 [kV]). In light of the foregoing, it has been found that variations in the secondary voltage in a distal end portion of the discharge spark of which the current value is large is moderate (in other words, the variation width of the secondary voltage is small), and the secondary current I2 is a more dominant parameter in terms of determining the magnitude of the value of discharge energy.

In addition, in accompaniment with this finding, it has been found that the energy density of the discharge spark can be approximated by dividing the secondary current I2 by the discharge path length L. Furthermore, when the energy density of the discharge spark is the same, a relationship is such that the discharge energy of the discharge spark increases and a surface area of the discharge spark increases as the discharge path length L increases. From this relationship, it has been found that the discharge path length L is a parameter that accurately reflects the magnitude of the discharge energy of the discharge spark.

As a result of the foregoing, whether the discharge spark that is generated in the spark plug 19 contributes to the combustion of the combustible air-fuel mixture can be estimated from the approximate energy density D. In addition, the discharge path length L of the discharge spark of which the approximate energy density D is greater than the predetermined value Th can be considered to be the discharge path length L of the discharge spark that contributes to the combustion of the combustible air-fuel mixture (provides the combustible air-fuel mixture with energy for combustion).

Therefore, it has been found that a sum of energy for combustion that is provided to the combustible air-fuel mixture can be estimated from an integrated value of the discharge path length L of the discharge spark. Furthermore, it has been found that the combustion state of the combustible air-fuel mixture can be accurately determined from the integrated value of the discharge path length L of the discharge spark.

Based on the foregoing findings, in the ignition control circuit 314 according to the present embodiment, combustion state determination control described below is performed. In the combustion state determination control, under a condition that, during a predetermined period from when conduction of the primary current I1 flowing to the primary coil 311A is blocked in the IGBT 312, the approximate energy density D calculated by a calculation method described hereafter is greater than the predetermined value Th, an integration process for integrating the discharge path length L of the discharge spark at this time is performed.

In addition, a combustion state determination control regarding the combustible air-fuel mixture described hereafter is performed based on the integrated value of the discharge path length L of the discharge spark calculated by the integration process upon elapse of the predetermined period.

According to the present embodiment, as shown in expression (1), the approximate energy density D is calculated by the secondary current I2 being divided by the discharge path length L that serves as a length of the discharge spark.

$$D=I2\div L \tag{1}$$

Figure 4:
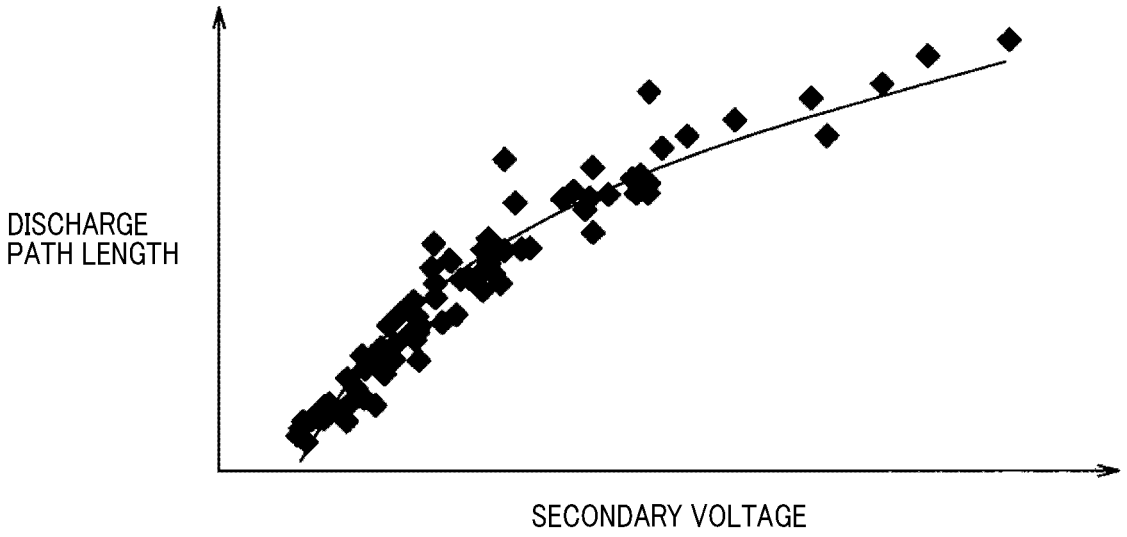
FIG. 4 is a graph of a relationship between the secondary voltage and a discharge path length.

Regarding the discharge path length L, as shown in FIG. 4, it has been found that a relationship between the secondary voltage V2 and the discharge path length L can be more accurately approximated by a natural logarithm. Therefore, as shown in expression (2), the discharge path length L is calculated based on a natural logarithm of an absolute value of the secondary voltage V2. Here, a and b are constants that appropriately prescribe the relationship between the secondary voltage V2 and the discharge path length L.

$$L=a\times\ln(V2)+b \tag{2}$$

The discharge path length L is successively calculated based on the detected secondary voltage V2. The approximate energy density D is also successively calculated based on the detected secondary current I2 and the calculated discharge path length L.

Figure 5:
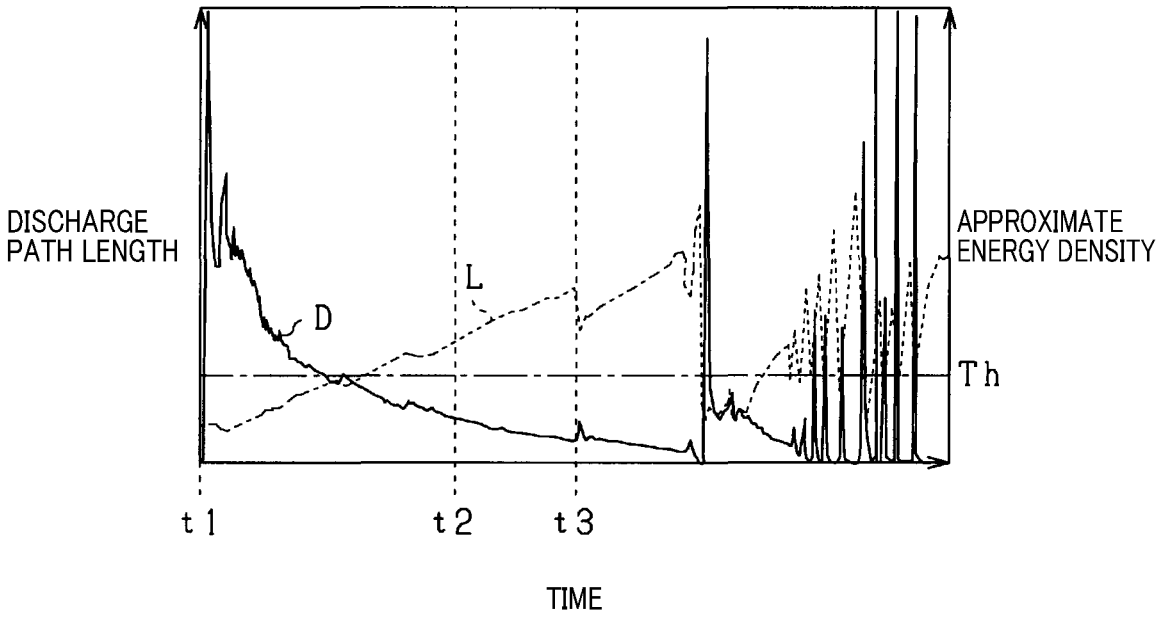
FIG. 5 is a diagram of an aspect of changes in an approximate energy density of a discharge spark and the discharge path length accompanying the passage of time.

The combustion state determination control will be described with reference to FIG. 5. FIG. 5 shows changes in time series in the approximate energy density D of the discharge spark and the discharge path length L subsequent to the discharge spark being generated in the spark plug 19 by conduction of the primary current I2 flowing to the primary coil 311A being blocked in the IGBT 312.

During the predetermined period (see time t1 to t3) from when conduction of the primary current I1 flowing to the primary coil 311A is blocked in the IGBT 312, the calculated discharge path length L of the discharge spark at this time is integrated until the approximate energy density D becomes less than the predetermined value Th (see time t2). An integration expression for the discharge path length L of the discharge spark of which the approximate energy density D is greater than the predetermined value Th is determined by a product of a step function u of a value obtained by the approximate energy density D being subtracted by the predetermined value Th and the discharge path length L being integrated, as shown in expression (3).

$$V=\int L\times u(D-Th)dt \tag{3}$$

The combustion state determination control is performed upon the elapse of the predetermined period. Specifically, under a condition that the approximate energy density D that is calculated in the integration process is greater than the predetermined value Th, whether the integrated value (referred to, hereafter, as the integrated value of the discharge path length L of which the approximate energy density D is large) of the discharge path length L obtained by the discharge path length L of the discharge spark at this time being integrated is less than a first threshold is determined.

When the integrated value of the integrated discharge path lengths L of which the approximate energy density D is large is determined to not be less than the first threshold, the discharge spark is determined to be sufficiently contributing to the combustion of the combustible air-fuel mixture.

Therefore, the combustion state of the combustible air-fuel mixture is determined to be favorable and discharge control is then ended.

Meanwhile, when the integrated value of the integrated discharge path lengths L of which the approximate energy density D is large is determined to be less than the first threshold, the discharge spark is determined to not be sufficiently contributing to the combustion of the combustible air-fuel mixture. The combustion state of the combustible air-fuel mixture is determined to be poor and re-discharge control is performed.

In the re-discharge control, first, the discharge spark that is being generated in the spark plug 19 is ended by the drive signal IG being outputted to the gate terminal of the IGBT 312 again. As a result, energy is supplied to the primary coil 311A from the power supply unit 313. Then, after the elapse of a second predetermined amount of time, the ignition control circuit 314 stops output of the drive signal IG to the gate terminal of the IGBT 312 and controls the spark plug 19 to perform re-discharge.

Here, the second predetermined amount of time is set to be shorter than the first predetermined amount of time. A reason for this is that, when the discharge spark that is being generated in the spark plug 19 is ended, electric power is assumed to still be stored in the primary coil 311A. The amount of time required for the electric power required to generate a re-discharge in the spark plug 19 to be stored is assumed to be short.

According to the present embodiment, the determination of the combustion state of the combustible air-fuel mixture is performed even when the re-discharge control is performed. As a result of the re-discharge control being performed, the discharge spark that is generated again in the spark plug 19 continuously heats the combustible air-fuel mixture that has been heated by the discharge spark that has been generated in the spark plug 19 up to this point.

Therefore, when the re-discharge control is performed, the integrated value of the discharge path length L of which the approximate energy density D is large that has been calculated during the predetermined period is added to the integrated value of the discharge path length L that has been calculated up to this point during a single combustion cycle. When the sum that is calculated as a result is less than the first threshold, the combustion state of the combustible air-fuel mixture is assumed to still not be favorable. Therefore, the re-discharge control is performed.

Meanwhile, when the calculated sum is not less than the first threshold, the combustion state of the combustible air-fuel mixture is assumed to have become favorable. Therefore, discharge generation control is not performed again. As a result of control such as this being performed, the integrated value of the discharge path length L can be controlled so as to be greater than the first threshold. In addition, the number of times that the discharge generation control is performed can be kept to a required minimum, so as to cause the combustion state of the combustible air-fuel mixture to be favorable.

Here, the combustible air-fuel mixture becomes more difficult to burn as the air-fuel ratio inside the combustion chamber leans toward the lean side. Therefore, to enable the combustible air-fuel mixture to favorably burn, the discharge spark of which the approximate energy density D is greater than the predetermined value Th is required to be generated for a longer amount of time. Therefore, the ignition control circuit 314 sets the first threshold to be greater as the air-fuel ratio increases (leans toward the lean side).

In addition, in the engine 11 in which the EGR passage 23 is provided as according to the present embodiment, the percentage of EGR gas in the combustion chamber increases as the EGR rate increases. Therefore, combustion of the combustible air-fuel mixture becomes more difficult. When the EGR gas content is high, the discharge spark of which the approximate energy density D is greater than the predetermined value Th is required to be generated for a longer amount of time to enable the combustible air-fuel mixture to favorably burn. Therefore, the ignition control circuit 314 sets the first threshold to be greater as the EGR rate increases.

When the discharge spark is generated in the spark plug 19 by the primary current I1 being blocked, noise is assumed to be generated in the secondary voltage V2 that is applied to the voltage detection path L3 and the secondary current I2 that flows to the current detection path L1. During a period in which the noise is generated, error being included in the calculated approximate energy density D and discharge path length L can be considered. Therefore, the above-described combustion state determination control is preferably not performed during this period. Taking this into consideration, according to the present embodiment, a predetermined mask period is set with a point immediately after the conduction of the primary current I1 flowing to the primary coil 311A being blocked in the IGBT 312 as a starting point. The above-described predetermined period is set so as to exclude the mask period.

In addition, when the period over which the discharge spark is generated in the spark plug 19 increases, the discharge spark stretches into a "U" shape as a result of airflow inside the combustion chamber 11*b*. At this time, when a location at which a distance between spark discharges that face each other is a short distance is present, the spark discharges may become joined at this location, and a discharge short in which a stretched portion of the discharge spark following the location is extinguished may occur. Noise is generated in the secondary voltage V2 and the secondary current I2 when the discharge short occurs as well. Therefore, the above-described predetermined period is set so as not to overlap with a period in which the probability of a short occurring in the discharge spark generated in the spark plug 19 increases.

Figure 6:
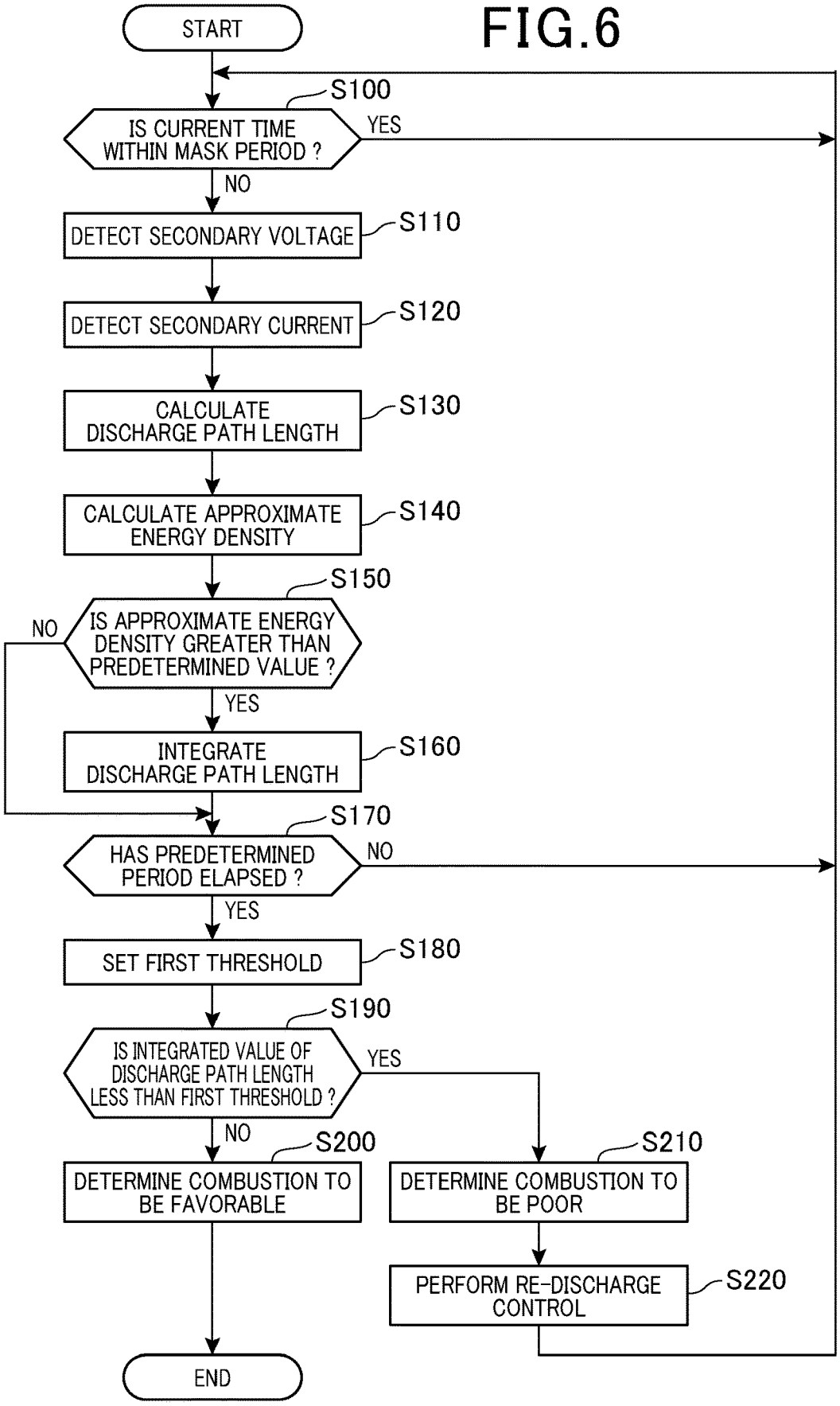
FIG. 6 is a flowchart of control performed by an ignition control circuit according to the present embodiment.

According to the present embodiment, the combustion state determination control shown in FIG. 6, described hereafter, is performed by the ignition control circuit 314. The combustion state determination control shown in FIG. 6 is repeatedly performed at a predetermined cycle by the ignition control circuit 314, during a discharge period that is a period during which the spark plug 19 is made to perform discharge that is started by the conduction of the primary current I1 flowing to the primary coil 311A being blocked in the IGBT 312.

First, at step S100, the ignition control circuit 314 determines whether a current time is included within the mask period. When determined that the current time is not included within the mask period (NO at step S100), the ignition control circuit 314 proceeds to step S110.

At step S110, the ignition control circuit 314 detects the secondary voltage V2 that is applied to the voltage detection path L3. At step S120, the ignition control circuit 314 detects the secondary current I2 that flows to the current detection path L1.

At step S130, the ignition control circuit 314 calculates the discharge path length L based on the natural logarithm of the absolute value of the secondary voltage V2. At step S140, the ignition control circuit 314 calculates the approximate energy density D by dividing the secondary current I2 by the discharge path length L.

At step S150, the ignition control circuit 314 determines whether the approximate energy density D calculated at step S140 is greater than the predetermined value Th. When determined that the approximate energy density D is not greater than the predetermined value Th (NO at S150), the ignition control circuit 314 proceeds to step S170, described hereafter. When determined that the approximate energy density D is greater than the predetermined value Th (YES at S150), the ignition control circuit 314 proceeds to step S160. At step S160, the ignition control circuit 314 integrates the discharge path length L calculated at step S130.

At step S170, the ignition control circuit 314 determines whether the predetermined period for integrating the discharge path length L has elapsed. When determined that the predetermined period has elapsed (YES at S170), the ignition control circuit 314 proceeds to step S180. At step S180, the ignition control circuit 314 sets the first threshold based on the air-fuel ratio detected by the air-fuel ratio sensor 40 and the EGR rate calculated based on the degree of opening of the EGR control valve 24. At step S190, the ignition control circuit 314 determines whether the integrated value of the discharge path length L integrated at step S160 is less than the first threshold.

When determined that the integrated value of the discharge path length L is not less than the first threshold (NO at S190), the ignition control circuit 314 proceeds to step S200. The ignition control circuit 314 determines that the combustion state of the combustible air-fuel mixture is favorable and ends the present control. When determined that the integrated value of the discharge path length L is less than the first threshold (YES at S190), the ignition control circuit 314 proceeds to step S210. The ignition control circuit 314 determines that the combustion state of the combustible air-fuel mixture is poor and proceeds to step S220. At step S220, the ignition control circuit 314 performs the re-discharge control and returns to step S100.

When determined that the current time is included within the mask period (YES at S100), or when determined that the predetermined period for integrating the discharge path length L has not elapsed (NO at S170), the ignition control circuit 314 returns to step S100.

Here, in the combustion state determination control performed during the re-discharge control, a portion of the control content thereof is changed. Specifically, in the determination process at step S190, the determination process is changed to that in which whether a sum of the integrated value of the discharge path length L integrated at step S160 and the integrated value of the discharge path length L calculated up to this point during a single combustion cycle is less than the first threshold is determined. Other steps are identical to the steps in the combustion state determination control during the initial discharge.

Here, the process at step S130 corresponds to a process as the discharge path length calculating unit. The process at step S140 corresponds to a process as the approximate energy density calculating unit. The processes at step S150 and step S160 correspond to a process as the integrated value calculating unit.

Next, an aspect of the combustion state determination control according to the present embodiment will be described with reference to FIG. 7.

Figure 7:
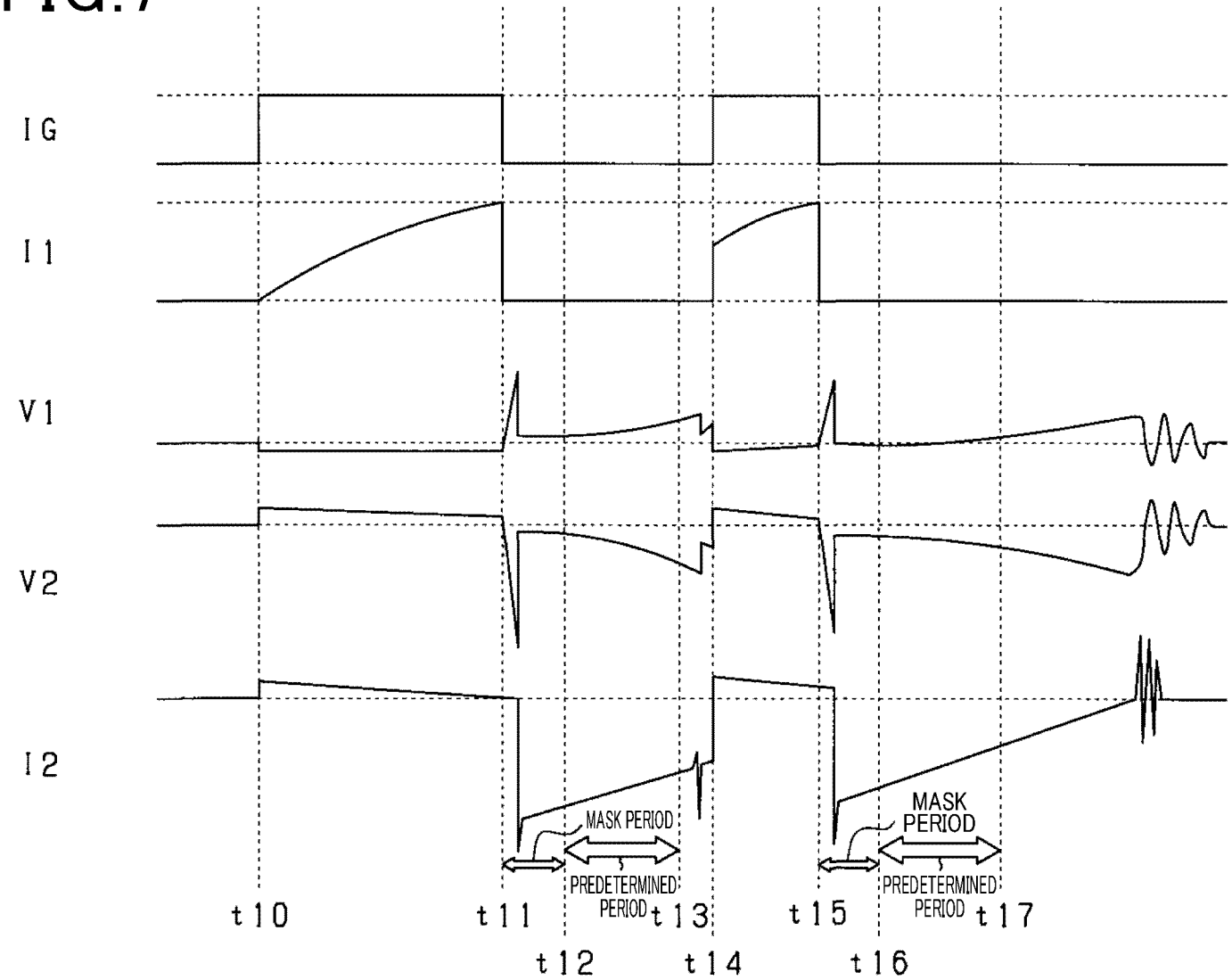
FIG. 7 is a time chart of operations in combustion state determination control according to the present embodiment.

In FIG. 7, "IG" indicates whether the drive signal IG is outputted to the gate terminal of the IGBT 312 by high/low. "I1" indicates the value of the primary current I1 that flows to the primary coil 311A. "V1" indicates the value of the primary voltage V1 that is applied to the primary coil 311A. In addition, "V2" indicates the value of the secondary voltage V2 that is applied to the spark plug 19. "I2" indicates the value of the secondary current I2 that flows to the spark plug 19.

The drive signal IG is transmitted to the gate terminal of the IGBT 312 (see time t10) by the ignition control circuit 314 that receives the ignition signal IGt from the electronic control unit 32. As a result, the IGBT 312 enters a closed state and the primary current I1 flows to the primary coil 311A. Then, after the elapse of the first predetermined amount of time, the output of the ignition signal IGt to the ignition control circuit 314 from the electronic control unit 32 is stopped. Therefore, in accompaniment, the output of the drive signal IG to the gate terminal of the IGBT 312 by the ignition control circuit 314 is stopped (see time t11). As a result, the IGBT 312 enters an open state and the conduction of the primary current I1 flowing to the primary coil 311A is blocked. The secondary voltage V2 is induced in the secondary coil 311B and dielectric breakdown occurs in the gas in the spark gap portion of the spark plug 19. As a result, the discharge spark is generated in the spark plug 19.

The approximate energy density D is not calculated until the predetermined mask period elapses (see time t11 to t12) from when the discharge spark is generated in the spark plug 19 (from when the conduction of the primary current I1 flowing to the primary coil 311A is blocked). During the predetermined period (see time t12 to t13) provided after the predetermined mask period, the approximate energy density D is calculated by the detected secondary current I2 being divided by the discharge path length L of the discharge spark that is calculated based on the detected secondary voltage V2. Then, under a condition that the calculated approximate energy density D is greater than the predetermined value Th, the discharge path length L of the discharge spark at this time is integrated.

After the elapse of the predetermined period (see time t13), whether the integrated value of the discharge path length L of which the approximate energy density D is large that has been integrated during the predetermined period is less than the first threshold is determined. Then, as a result of the integrated value of the discharge path length L of which the approximate energy density D is large that has been integrated during the predetermined period being determined to be less than the first threshold, the ignition control circuit 314 transmits the drive signal IG to the gate terminal of the IGBT 312 again (see time t14). Subsequently, the output of the drive signal IG to the gate terminal of the IGBT 312 is stopped as a result of the elapse of the second predetermined amount of time (see time t14 to t15). As a result, the discharge spark is generated again in the spark plug 19.

In a manner similar to that during the initial discharge, during the re-discharge as well, the predetermined mask period is provided. The approximate energy density D is not calculated until the elapse of the predetermined mask period (see time t15 to t16) from when the discharge spark is generated in the spark plug 19. Then, under a condition that the calculated approximate energy density D is greater than the predetermined value Th during the predetermined period provided after the predetermined mask period, the discharge path length L of the discharge spark at this time is integrated (see time t16 to t17).

After the elapse of the predetermined period (see time t17), whether the sum of the integrated value of the discharge path length L of which the approximate energy density D is large that has been integrated during the predetermined period and the integrated value of the discharge path length L of which the approximate energy density D is large that has been integrated up to this point during a single combustion cycle is less than the first threshold is determined. As a result of the sum being determined to not be less than the first threshold, the re-discharge control is not performed and the discharge control is immediately ended.

Here, during an interval from time t13 to t14, large variations occur in the primary voltage V1, the secondary voltage V2, and the secondary current I2. The variations are thought to occur as a result of a short in the discharge spark that is generated in the spark plug 19. When a discharge short occurs in this manner, large variations occur in the primary voltage V1, the secondary voltage V2, and the secondary current I2. Therefore, an end point of the predetermined period is preferably set before a period during which the likelihood of the discharge short occurring increases.

As a result of the above-described configuration, according to the present embodiment, the following effects are achieved.

The re-discharge control is performed under a condition that the integrated value of the discharge path length L calculated during the predetermined period is less than the first threshold. As a result, the combustion state of the combustible air-fuel mixture can be made favorable.

Figure 8:
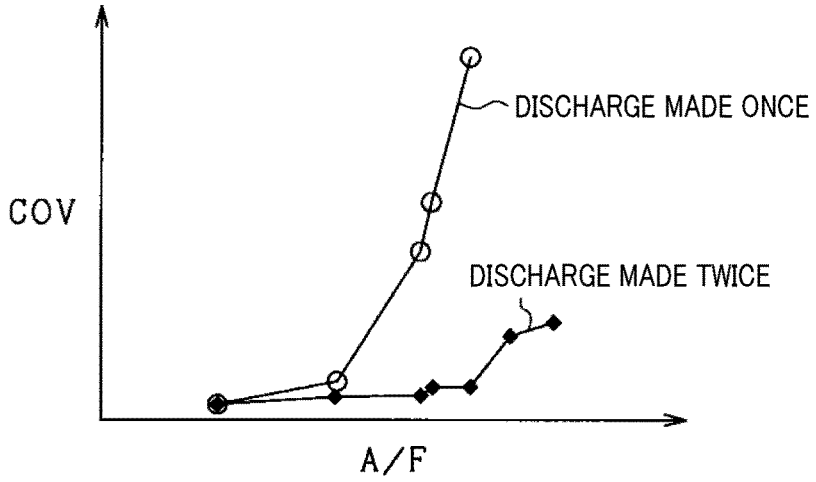
FIG. 8 is a graph of a comparison of changes in a torque variation rate accompanying increase in an air-fuel ratio, between when discharge is performed once and when discharge is performed twice.
Figure 9:
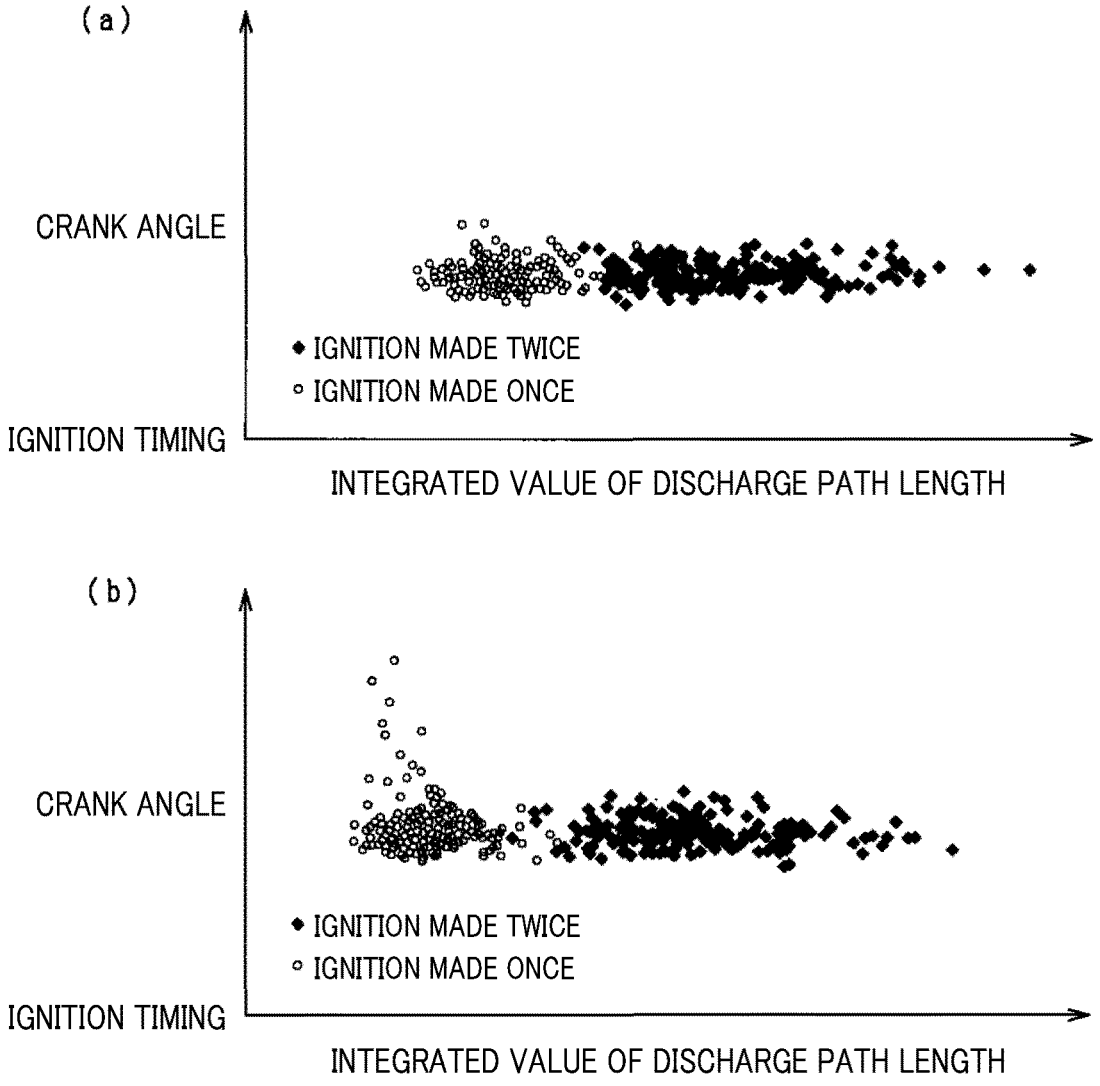
FIG. 9 is a diagram of a relationship between an integrated value of the discharge path length of which the approximate energy density is large and crank angles that are passed until 2% of an air-fuel mixture is burned.

FIG. 8 and FIG. 9 show that the combustion state of the combustible air-fuel mixture is actually improved by the re-discharge control being performed.

FIG. 8 is a comparison between data when the discharge spark is generated only once in the spark plug 19 and data when the discharge spark is generated twice in the spark plug 19 according to the present embodiment, the data being that regarding the extent of variation in a torque variation rate of the engine 11 as the air-fuel ratio inside the combustion chamber 11*b* leans towards the lean side. Based on FIG. 8, it is clear that the torque variation rate increases as the air-fuel ratio increases (the air-fuel ratio leans toward lean), when the discharge spark is generated only once in the spark plug 19.

That is, it is suggested that the frequency of misfire occurring in the engine 11 increases as the air-fuel ratio increases. Meanwhile, when the discharge spark is generated twice in the spark plug 19 according to the present embodiment, compared to the data when the discharge spark is generated only once in the spark plug 19, the torque variation rate when the air-fuel ratio increases can be reduced. Based on the foregoing, it is suggested that the frequency of misfire occurring in the engine 11 can be reduced when the discharge spark is generated twice in the spark plug 19.

FIG. 9 shows, by (a), a comparison of data between when the discharge spark is generated only once in the spark plug 19 and when the discharge spark is generated twice in the spark plug 19 according to the present embodiment, in an environment in which the air-fuel ratio inside the combustion chamber 11*b* leans toward the rich side.

FIG. 9 shows, by (b), a comparison of data between when the discharge spark is generated only once in the spark plug 19 and when the discharge spark is generated twice in the spark plug 19 according to the present embodiment, in an environment in which the air-fuel ratio inside the combustion chamber 11*b* leans further toward the lean side than in a case shown in FIG. 9 by (a).

In each graph shown in FIG. 9 by (a) and (b), a vertical axis indicates crank angles that are passed until 2% of the mass of the combustible air-fuel mixture is burned from the ignition timing. Therefore, as the value of the vertical axis increases, the amount of time until the combustion air-fuel mixture is burned increases. The combustible air-fuel mixture is unable to be burned within the discharge period and the likelihood of a misfire occurring is high.

As shown in FIG. 9 by (a), in an environment in which the air-fuel ratio inside the combustion chamber 11*b* leans toward the rich side, even when the discharge spark is generated only once in the spark plug 19, the combustible air-fuel mixture can be burned in an amount of time that is equal to that when the discharge spark is generated twice in the spark plug 19 according to the present embodiment.

However, as shown in FIG. 9 by (b), in an environment in which the air-fuel ratio inside the combustion chamber 11*b* leans towards the lean side, among cases in which the discharge spark is generated only once in the spark plug 19, particularly regarding discharge sparks of which the integrated value of the discharge path length L of which the approximate energy density D is large, a significant amount of time tends to be required until the combustible air-fuel mixture is burned.

That is, it is suggested that, even when the discharge spark is generated only once in the spark plug 19, when the integrated value of the discharge path length L of which the approximate energy density D is large is large, the combustible air-fuel mixture can be favorably burned. Meanwhile, when the integrated value of the discharge path length L of which the approximate energy density D is large is small, the combustion state of the combustible air-fuel mixture tends to be poor.

In contrast, when the discharge spark is generated twice in the spark plug 19 according to the present embodiment in an environment in which the air-fuel ratio inside the combustion chamber 11 leans toward the lean side, the integrated value of the discharge path length L of which the approximate energy density D is large can be increased compared to that when the discharge spark is generated only once. Therefore, the combustion state of the combustible air-fuel mixture can be made favorable within the discharge period.

Consequently, as a result of the present combustion state determination control being performed, as a result of the re-discharge control being performed under a condition that the integrated value of the discharge path length L of which the approximate energy density D is large is less than the first threshold, the combustion state of the combustible air-fuel mixture can be improved.

In addition, when the integrated value of the discharge path length L of which the approximate energy density D is large that is calculated during the predetermined period is less than the first threshold, the combustion state of the combustible air-fuel mixture can be estimated as being favorable. Therefore, as a result of the re-discharge control not being performed, energy being unnecessarily consumed in the spark plug 19 can be suppressed.

Figure 10:
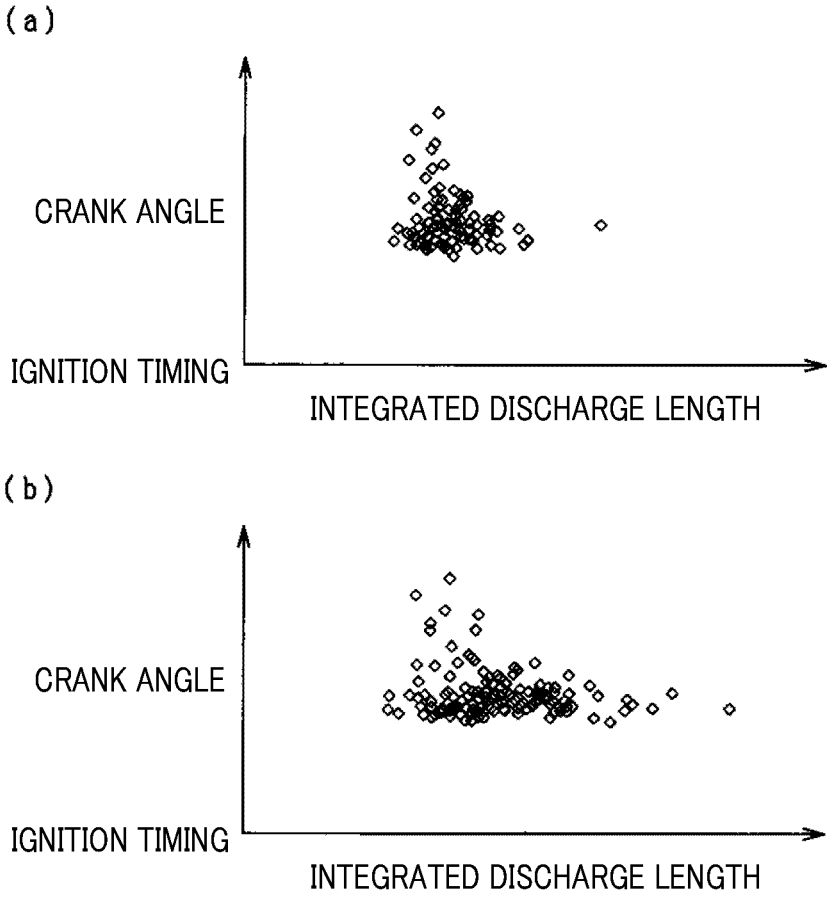
FIG. 10 is a diagram of a value obtained by the secondary current being divided by the discharge path length approximating energy density.

FIG. 10 shows, by (a), data indicating the value of the discharge path length L of the discharge spark that is integrated under a condition that the energy density that is calculated from the ignition timing until 2% of the mass of the combustible air-fuel mixture is burned is greater than the predetermined value Th.

FIG. 10 shows, by (b), data indicating the value of the discharge path length L of the discharge spark that is integrated under a condition that the approximate energy density D that is calculated from the ignition timing until 2% of the mass of the combustible air-fuel mixture is burned is greater than the predetermined value Th. The results shown in FIG. 10 by (a) and the results shown in FIG. 10 by (b)

substantially coincide. Therefore, the approximate energy density D is able to favorably approximate the energy density of the discharge spark. Here, experiments shown in FIG. 10 by (a) and (b) are both performed in equivalent environments.

As a result of the present combustion state determination control being performed through use of the approximate energy density D instead of the energy density, a calculation step for discharge energy can be omitted (in other words, a calculation step for calculating a product of the secondary current I2 and the secondary voltage V2 can be omitted). Furthermore, a calculation circuit that is required to perform the present control can be simplified.

The discharge spark of which the approximate energy density D is greater than the predetermined value is thought to contribute to the combustion of the combustible air-fuel mixture. However, the combustion state of the combustible air-fuel mixture differs (for example, combustion is promoted as heat that is provided increases) based on a total area of the combustible air-fuel mixture facing the discharge spark (a total amount of combustible air-fuel mixture that is provided with heat by the discharge spark). Therefore, as a result of the integrated value of the discharge path length L of which the approximate energy density D is large being calculated, the total area over which the combustible air-fuel mixture faces the discharge spark can be ascertained. Furthermore, the combustion state of the combustible air-fuel mixture can be estimated.

As a result of the discharge path length L being calculated based on the natural logarithm of the absolute value of the secondary voltage V2 as shown in expression (2), a map or the like that prescribes the relationship therebetween in advance is not required to be prepared. The discharge path length L can be calculated by a calculation formula.

The first threshold is set to be greater as the air-fuel ratio of the combustible air-fuel mixture increases. As a result, the combustion state of the air-fuel mixture can be more accurately estimated.

The first threshold is set to be greater as the EGR gas increases. As a result, the combustion state of the air-fuel mixture can be more accurately estimated.

The predetermined period is set so as to exclude the predetermined mask period immediately after the conduction of the primary current I1 flowing to the primary coil 311A is blocked in the IGBT 312. As a result, error included in the integrated value of the discharge path length L of which the approximate energy density D is large can be reduced.

In the present combustion state determination control, the combustion state of the combustible air-fuel mixture is estimated based on the integrated value of the discharge path length L of the discharge spark in a state in which the approximate energy density D is greater than the predetermined value Th. Therefore, erroneous estimation of the combustion state of the combustible air-fuel mixture can be suppressed even in an environment in which the flow rate of gas inside the combustion chamber 11 is high.

The above-described embodiment can also be carried out with modifications such as those below.

According to the above-described embodiment, the combustion state determination control is performed by the ignition control circuit 314. Regarding this point, the combustion state determination control may be performed by the electronic control unit 32. Alternatively, the combustion state determination control may be performed by the electronic control unit 32 and the ignition control circuit 314 in cooperation. In addition, a separate circuit that is not limited to the electronic control unit 32 or the ignition control circuit 314 may perform the combustion state determination control.

Figure 11:
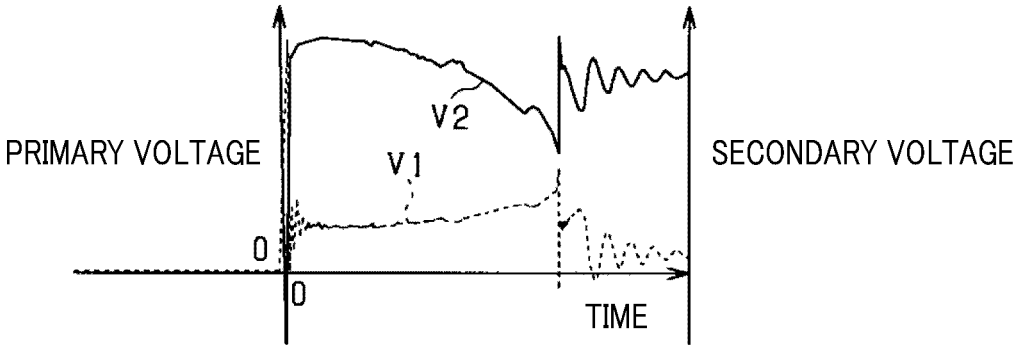
FIG. 11 is a diagram of a relationship between a primary voltage and the secondary voltage.

According to the above-described embodiment, the secondary voltage V2 that is applied to the voltage detection path L3 is calculated. The discharge path length L and the approximate energy density D are calculated through use of the detected secondary voltage V2. Here, symbols of the secondary voltage V2 and the primary voltage V1 are inverted, the magnitudes of the values differ. However, as shown in FIG. 11, an aspect of change in the primary voltage V1 tends to take on an aspect of change that is similar to that of the secondary voltage V2.

Therefore, the primary voltage V1 may serve as a substitute for the secondary voltage V2. Specifically, the ignition control unit 31 may be configured to include a voltage detection path that detects the primary voltage V1 that is applied to the primary coil 311A, instead of the voltage detection path L3. The discharge path length L may be calculated through use of the detected primary voltage V1.

According to the above-described embodiment, the approximate energy density D is calculated by the secondary current I2 being divided by the discharge path length L. Regarding this point, for example, the approximate energy density D may be calculated by a current value amounting to noise being subtracted from the secondary current I2, and the value thereof being divided by the discharge path length L. Alternatively, a map that indicates the relationship among the secondary current I2, the discharge path length L, and the approximate energy density D may be generated in advance. The approximate energy density D may be acquired from the secondary current I2 and the discharge path length L with reference to the map.

According to the above-described embodiment, the discharge path length L is calculated based on the natural logarithm of the absolute value of the secondary voltage V2 as shown in expression (2). Regarding this point, a map that prescribes the relationship between the secondary voltage V2 and the discharge path length L in advance may be prepared. The discharge path length L may be estimated from the detected secondary voltage V2 with reference to the map.

According to the above-described embodiment, the ignition control circuit 314 sets the first threshold. Regarding this point, the ignition control circuit 314 is not required to set the first threshold. For example, the electronic control unit 32 may set the first threshold.

According to the above-described embodiment, the first threshold that serves as a threshold for determining whether the combustion state of the combustible air-fuel mixture is favorable is set to be greater as the air-fuel ratio increases (leans toward the lean side) or the EGR rate increases. Regarding this point, the first threshold may be a fixed value.

According to the above-described embodiment, the present combustion state determination control is performed even when the re-discharge control is performed. Regarding this point, when the re-discharge control is performed, the combustion state of the combustible air-fuel mixture may be considered improved and the present combustion state determination control may not be performed. In this case, the frequency of execution of the combustion state determination control can be reduced. Reduction of load placed on the ignition control circuit 314 becomes possible.

According to the above-described embodiment, the predetermined mask period is set with the point immediately after the conduction of the primary current I1 flowing to the primary coil 311A being blocked in the IGBT 312 as the starting point. Regarding this point, the mask period may not be set. The predetermined period may be set immediately after the conduction of the primary current I1 flowing to the primary coil 311A is blocked in the IGBT 312.

The ignition circuit unit 31 according to the above-described embodiment is mounted in the engine 11 in which airflow, such as a swirl flow or a tumble flow, is generated inside the combustion chamber 11*a* by the airflow control valve 27 that is provided near the intake port 13, when homogeneous lean burn is performed. Regarding this point, the ignition circuit unit 31 according to the above-described embodiment is not necessarily required to be mounted in the engine 11 in which the airflow control valve 27 is provided.

Figure 12:
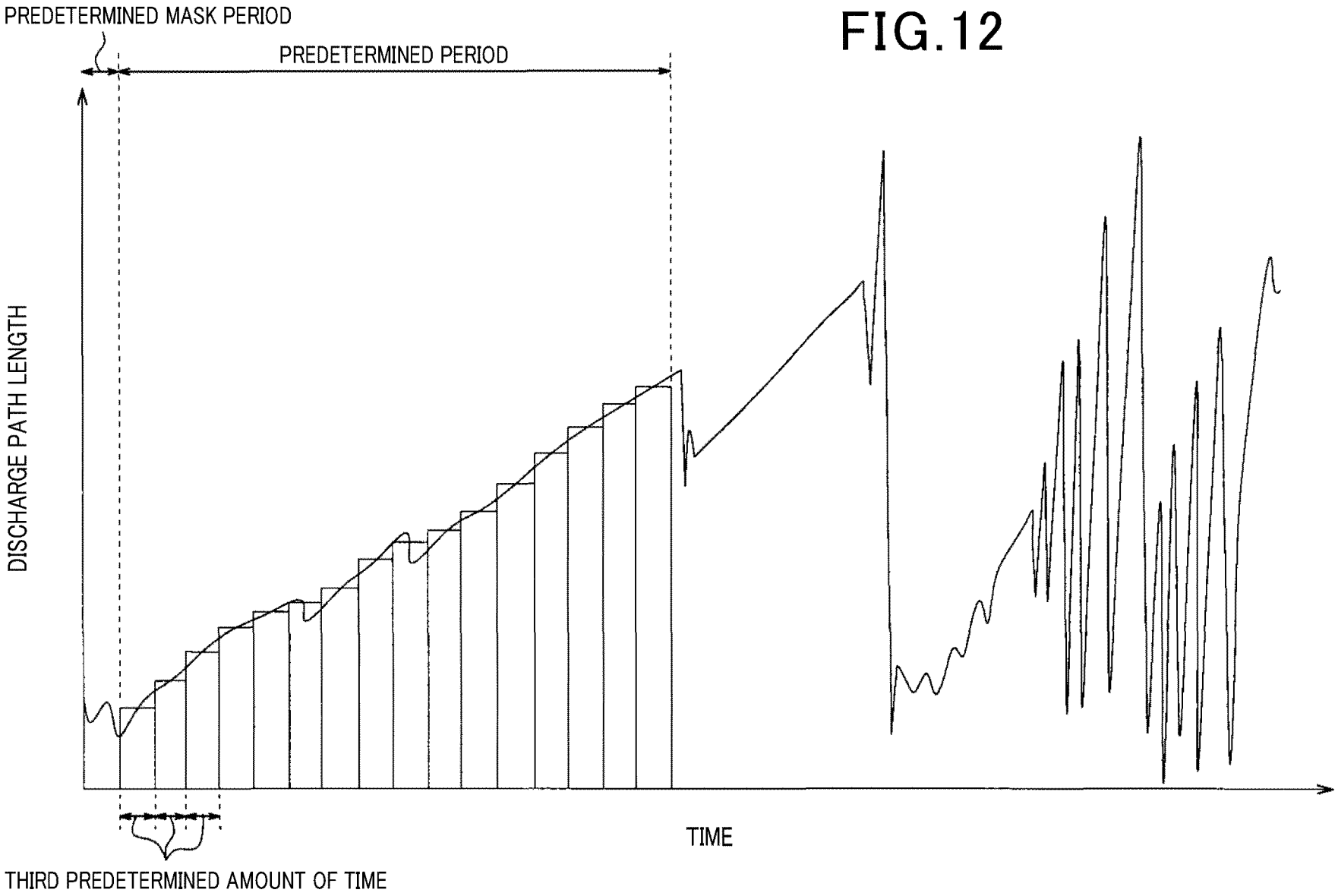
FIG. 12 is a diagram of another method for calculating the integrated value of the discharge path length of which the approximate energy density is large.

According to the above-described embodiment, the discharge path length L is calculated based on expression (3). Regarding this point, the discharge path length L is not necessarily required to be calculated based on expression (3). For example, as shown in FIG. 12, the discharge path length L of the discharge spark that is generated in the spark plug 19 may be calculated each time a third predetermined amount of time (such as 0.02 ms) elapses during the predetermined period. All of the discharge path lengths L calculated each time the third predetermined amount of time elapses may be added upon the elapse of the predetermined period, and the integrated value of the discharge path length L may be calculated. Here, regarding a graph shown in FIG. 12, at least the discharge sparks during the predetermined period are assumed to be in a state in which the approximate energy density D is higher than the first threshold.

The discharge spark that is generated in the spark plug 19 may be extinguished (discharge ended) before the elapse of the predetermined period as a result of the discharge spark generated in the spark plug 19 being blown out due to the flow rate inside the cylinder being high, carbon that is produced by incomplete combustion of fuel attaching to an electrode outer circumferential portion of the spark plug 19 and flashover discharge being generated between the carbon and an attachment fixture of the spark plug 19, or the like.

In this case, discharge is assumed to end before the combustible air-fuel mixture is sufficiently heated. The likelihood of the combustion state of the combustible air-fuel mixture not being favorable is high. As a countermeasure, the re-discharge control is immediately performed when the absolute value of the secondary current I2 that flows to the current detection path L1 becomes less than a second threshold during the predetermined period.

Figure 13:
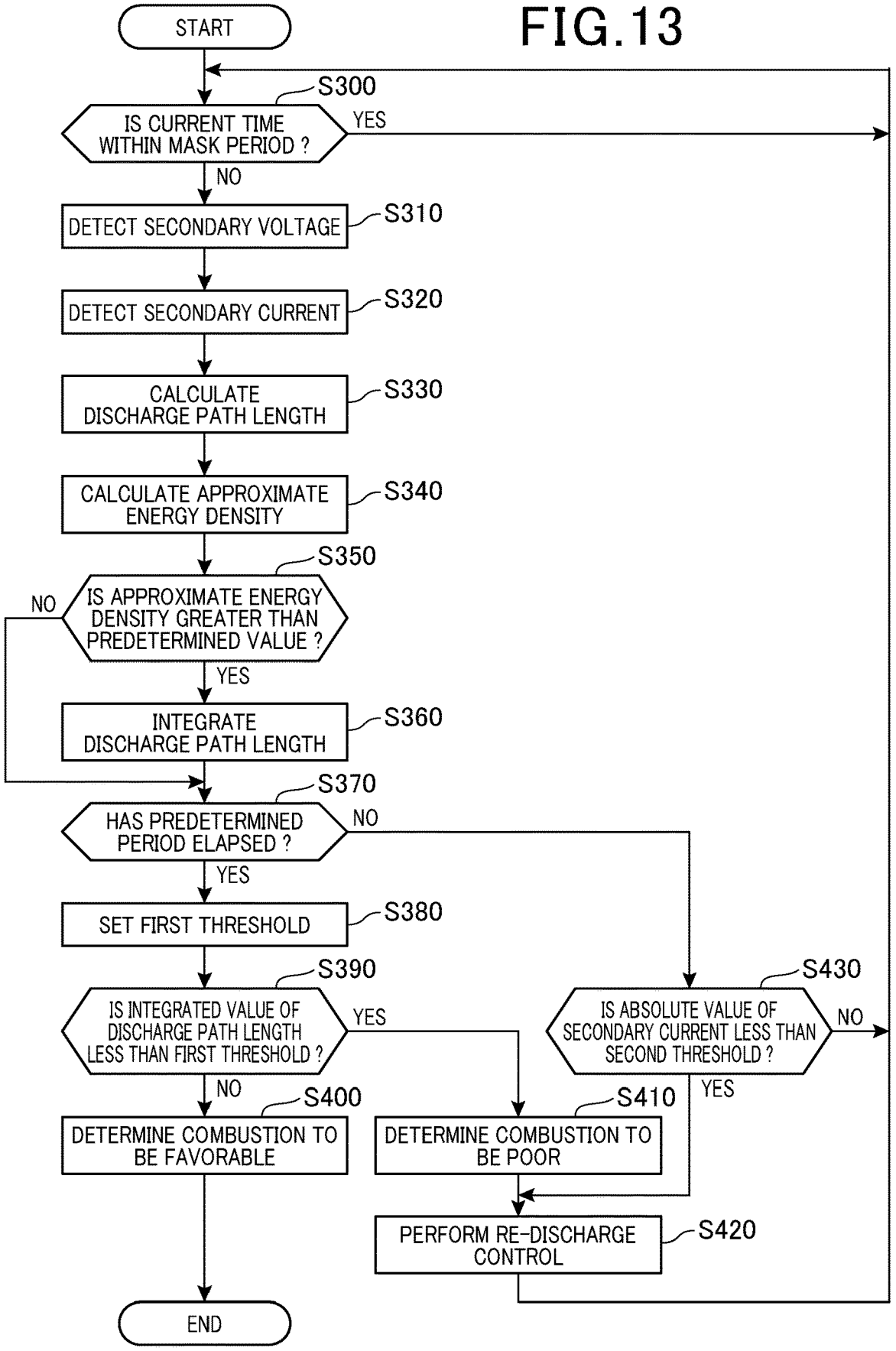
FIG. 13 is a flowchart of control performed by the ignition control circuit in another example.

FIG. 13 is a modification of the flowchart shown in FIG. 6. That is, step S430 is newly added as a step to which the ignition control circuit 314 proceeds when the ignition control circuit 314 determines NO in a determination process at step S370 that corresponds to step S170 in FIG. 6.

At step S430, the ignition control circuit 314 determines whether the absolute value of the secondary current I2 detected at step S320 that corresponds to step S120 is less than the second threshold. When determined that the absolute value of the secondary current I2 is not less than the second threshold (NO at S430), the ignition control circuit 314 returns to step S300. When determined that the absolute value of the secondary current I2 is less than the second threshold (YES at S430), the ignition control circuit 314 proceeds to step S420 that corresponds to step S220.

Regarding other steps, processes at each of steps S300, 310, 330, 340, 350, 360, 380, 390, 400, and 410 in FIG. 13 are respectively identical to the processes at each of steps S100, 110, 130, 140, 150, 160, 180, 190, 200, and 210 in FIG. 6.

As a result, even should the discharge spark that is generated in the spark plug 19 be extinguished during the predetermined period, as a result of the re-discharge control being immediately performed, the discharge spark can be generated again in the spark plug 19. Furthermore, an interval from when discharge is ended until the discharge spark is generated again can be shortened.

Figure 14:
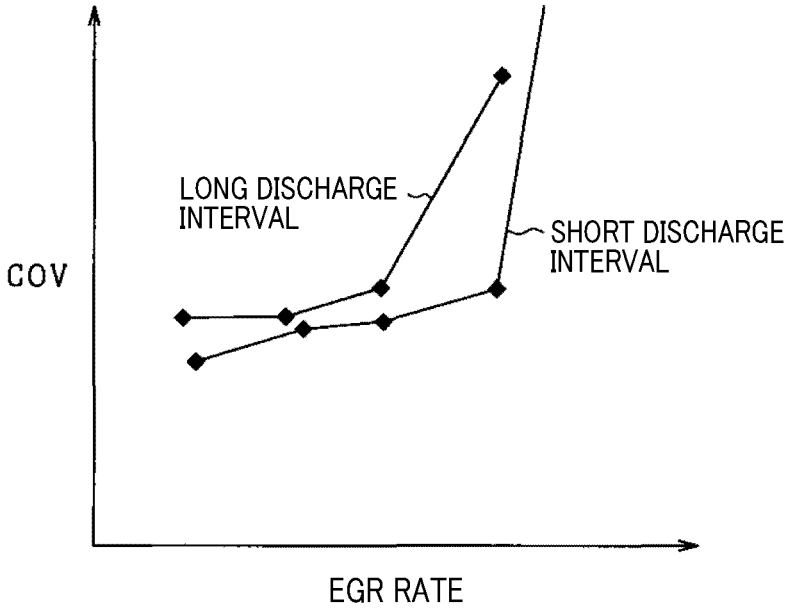
FIG. 14 is a diagram of an effect that the torque variation rate accompanying increase in an EGR amount has on a discharge interval when discharge is performed twice.

As shown in FIG. 14, the torque variation rate can be decreased even in an environment in which the EGR rate is high, as the discharge interval when discharge is performed twice is shortened. A reason for this is thought to be that, because the combustible air-fuel mixture that has been heated by the discharge spark that has been generated first can be heated again by the second discharge spark that is generated by the re-discharge control, deterioration of the ignitability of the combustible air-fuel mixture and the combustion state can be suppressed.

In another example, the re-discharge control is immediately performed when the absolute value of the second current I2 that flows to the current detection path L1 becomes less than the second threshold during the predetermined period. Regarding this point, the determination may be performed based on the absolute value of the primary voltage V1, the absolute value of the secondary voltage V2, or the approximate energy density D, instead of the absolute value of the secondary current I2.

Specifically, the configuration may be such that the re-discharge control is immediately performed when the absolute value of the primary voltage V1 or the absolute value of the secondary voltage V2 becomes less than a third threshold that is provided to identify 0 during the predetermined period. Alternatively, the configuration may be such that the re-discharge control is immediately performed when the approximate energy density D becomes less than a fourth threshold during the predetermined period.

Here, a relationship among the predetermined value Th and the first threshold to third threshold is as follows. The predetermined threshold Th is a threshold for determining whether the discharge spark that is generated in the spark plug 19 contributes to the combustion of the combustible air-fuel mixture.

The first threshold is a threshold for determining that the discharge spark sufficiently contributes to the combustion of the combustible air-fuel mixture and, therefore, the combustion state of the combustible air-fuel mixture is favorable, based on the discharge path length L.

The second threshold is a threshold for determining whether the discharge spark that is generated in the spark plug 19 has been extinguished during the predetermined period, based on the absolute value of the secondary current I2.

The third threshold is a threshold for determining whether the discharge spark that is generated in the spark plug 19 has been extinguished during the predetermined period, based on the absolute value of the primary voltage V1 or the absolute value of the secondary voltage V2.

The fourth threshold is a threshold for determining whether the discharge spark that is generated in the spark plug 19 has been extinguished during the predetermined period, based on the absolute value of the approximate energy density D.

At this time, because the re-discharge control is immediately performed when the discharge spark that is generated in the spark plug 19 is determined to be extinguished during the predetermined period, it can be said, in other words, that the second threshold to fourth threshold are all thresholds that determine whether the re-discharge control is to be immediately performed. Therefore, the third threshold corresponds to the second threshold in the scope of claims.

While the present disclosure has been described with reference to embodiments thereof, it is to be understood that the disclosure is not limited to the embodiments and constructions. The present disclosure is intended to cover various modification examples and modifications within the range of equivalency. In addition, various combinations and configurations, and further, other combinations and configurations including more, less, or only a single element thereof are also within the spirit and scope of the present disclosure.

What is claimed is:

1. An ignition control system that is applied to an internal combustion engine that includes a spark plug that generates, between a pair of discharge electrodes, a discharge spark for igniting a combustible air-fuel mixture inside a cylinder of the internal combustion engine, an ignition coil that includes a primary coil and a secondary coil and applies a secondary voltage to the spark plug through the secondary coil, a voltage value detector that detects a voltage value of at least either of a primary voltage that is applied to the primary coil and the secondary voltage that is applied to the spark plug, and a secondary current detector that detects a secondary current that flows to the spark plug, the ignition control system comprising:

an ignition control circuit configured to at least provide:

a primary current control that performs discharge generation control, in which the discharge spark is generated in the spark plug, once or a plurality of times during a single combustion cycle by causing blocking of a primary current to the primary coil to be performed after conduction of the primary current is performed;

a discharge path length calculation that successively calculates a discharge path length as a length of the discharge spark that is formed between the discharge electrodes based on the voltage value detected by the voltage value detector;

an approximate energy density calculation that successively calculates an approximate energy density that serves as an approximate value of energy density that is energy per unit length of the discharge spark, based on the secondary current detected by the secondary current detector and the discharge path length calculated by the discharge path length calculation; and an integrated value calculation that, during a predetermined period after blocking of the primary current is performed during the single combustion cycle, based on the approximate energy density calculated by the approximate energy density calculation being greater than a predetermined value, calculates an integrated value by integrating the discharge path length calculated at this time by the discharge path length calculation, wherein the primary current control performs the discharge generation control again based on the integrated value calculated by the integrated value calculation being less than a first threshold.

2. The ignition control system according to claim 1, wherein:

the discharge path length calculation calculates the discharge path length based on a natural logarithm of an absolute value of the voltage value detected by the voltage value detector.

3. The ignition control system according to claim 2, wherein:

the first threshold is set to be greater as an air-fuel ratio of the combustible air-fuel mixture increases.

4. The ignition control system according to claim 3, wherein:

the internal combustion engine includes an exhaust gas recirculation mechanism that recirculates exhaust gas in which the combustible air-fuel mixture has been burned into the cylinder; and the first threshold is set to be greater as a recirculation amount of the exhaust gas increases.

5. The ignition control system according to claim 4, wherein:

the integrated value calculation calculates the integrated value during the predetermined period when the discharge generation control is performed again by the primary current control; and the primary current control performs the discharge generation control again when a sum of a currently calculated integrated value being added to the integrated value integrated by the integrated value calculation up to a current point during the single combustion cycle is less than the first threshold.

6. The ignition control system according to claim 5, wherein:

the primary current control immediately performs the discharge generation control again when at least one value among an absolute value of the voltage value detected by the voltage value detector, an absolute value of the secondary current detected by the secondary current detector, and the approximate energy density calculated the approximate energy density calculation is less than a second threshold during the predetermined period.

7. The ignition control system according to claim 6, wherein:

the predetermined period is set so as to exclude a predetermined mask period immediately after the primary current is blocked.

8. The ignition control system according to claim 7, wherein:

the internal combustion engine includes an airflow control valve that generates an airflow inside the cylinder; and the airflow control valve generates the airflow inside the cylinder when a homogeneous and air-fuel mixture is generated inside the cylinder and homogeneous lean burn is performed.

9. The ignition control system according to claim 1, wherein:

the first threshold is set to be greater as an air-fuel ratio of the combustible air-fuel mixture increases.

10. The ignition control system according to claim 1, wherein:

the internal combustion engine includes an exhaust gas recirculation mechanism that recirculates exhaust gas in which the combustible air-fuel mixture has been burned into the cylinder; and the first threshold is set to be greater as a recirculation amount of the exhaust gas increases.

11. The ignition control system according to claim 1, wherein:

the integrated value calculation calculates the integrated value during the predetermined period when the discharge generation control is performed again by the primary current control; and the primary current control performs the discharge generation control again when a sum of a currently calculated integrated value being added to the integrated value integrated by the integrated value calculation up to a current point during the single combustion cycle is less than the first threshold.

12. The ignition control system according to claim 1, wherein:

the primary current control immediately performs the discharge generation control again when at least one value among an absolute value of the voltage value detected by the voltage value detector, an absolute value of the secondary current detected by the secondary current detector, and the approximate energy density calculated the approximate energy density calculation is less than a second threshold during the predetermined period.

13. The ignition control system according to claim 1, wherein:

the predetermined period is set so as to exclude a predetermined mask period immediately after the primary current is blocked.

14. The ignition control system according to claim 1, wherein:

the internal combustion engine includes an airflow control valve that generates an airflow inside the cylinder; and the airflow control valve generates the airflow inside the cylinder when a homogeneous and lean air-fuel mixture is generated inside the cylinder and homogeneous lean burn is performed.

15. The ignition control system according to claim 1, wherein:

the approximate energy density calculation successively calculates the approximate energy density that is the approximate value of the energy density of the discharge spark by dividing the secondary current detected by the secondary current detector by the discharge path length calculated by the discharge path length calculation.

16. The ignition control system according to claim 15, wherein:

when the integrated value is less than the first threshold, a combustion state of the combustible air-fuel mixture is estimated as not being favorable; and when the integrated value is greater than the first threshold, the combustion state of the combustible air-fuel mixture is estimated as being favorable.

17. The ignition control system according to claim 1, wherein:

when the integrated value is less than the first threshold, a combustion state of the combustible air-fuel mixture is estimated as not being favorable; and when the integrated value is greater than the first threshold, the combustion state of the combustible air-fuel mixture is estimated as being favorable.

* * * * *